United States Patent [19]

Schrupp

[11] Patent Number: 4,793,476

[45] Date of Patent: Dec. 27, 1988

[54] DEVICE FOR DISPENSING A CONCENTRATE INTO A LIQUID WITHOUT EXPOSING THE CONCENTRATE TO THE ATMOSPHERE

[75] Inventor: Earl H. Schrupp, 3740 Tonkawood Rd., Minnetonka, Minn. 55345

[73] Assignee: Earl H. Schrupp, Minnetonka, Minn.

[21] Appl. No.: 175,148

[22] Filed: Mar. 30, 1988

[51] Int. Cl.[4] ..... B65D 81/32

[52] U.S. Cl. ..... 206/222; 215/6; 215/DIG. 8; 239/309

[58] Field of Search ..... 206/219–222; 215/6, 10, DIG. 8, 250; 220/267, 278; 222/83; 239/309, 302

[56] References Cited

U.S. PATENT DOCUMENTS

| | | | |
|---|---|---|---|
| 1,948,306 | 2/1934 | Meurer | 299/90 |
| 2,167,866 | 8/1939 | Bennett | 239/309 |
| 2,420,223 | 5/1947 | Brewer | 299/95 |
| 3,166,096 | 1/1965 | Lang | 137/564.5 |
| 3,244,331 | 4/1966 | Kharasch | 222/211 |
| 3,251,420 | 5/1966 | Rodgers | 239/309 |
| 3,517,885 | 6/1970 | Blake | 239/390 |
| 3,587,968 | 6/1971 | Hennart | 239/47 |
| 4,465,183 | 8/1984 | Saito et al. | 206/222 |
| 4,614,267 | 9/1986 | Larkin | 206/219 |
| 4,741,437 | 5/1988 | Gorski et al. | 206/222 |

*Primary Examiner*—Jimmy G. Foster

*Attorney, Agent, or Firm*—Merchant, Gould, Smith, Edell, Welter & Schmidt

[57] ABSTRACT

A device which can dispense a composition such as a pesticide, herbicide, fungicide, or other toxic composition into a liquid such as a solvent without exposing the composition to the atmosphere. The device comprises a jacket having a perforated top and an open bottom; a container having an open top which is sized to be removably retained within the jacket; a means for breaking a seal over the top of the container only after the container has been sealingly engaged within the jacket; a means for sealingly engaging the container and the jacket after the container has been inserted a predetermined distance into the jacket; and a graspable element coupled to the base of the container for allowing the container to be manipulated when the container is retained within the jacket.

9 Claims, 2 Drawing Sheets

DEVICE FOR DISPENSING A CONCENTRATE INTO A LIQUID WITHOUT EXPOSING THE CONCENTRATE TO THE ATMOSPHERE

FIELD OF THE INVENTION

My invention relates to the dilution of a concentrate. More specifically my invention relates to the dispensing of a concentrate into a liquid without exposing the chemical to the open atmosphere.

BACKGROUND OF THE INVENTION

Potentially toxic compositions such as pesticides, herbicides and fungicides are generally sold as either a dilute ready-to-use solution or a dilutable concentrate. The ready-to-use solutions are safer and easier to use as the composition is provided in dilute form and do not require additional handling, while the concentrated solutions are less expensive as they don't require the shipping and handling of large amounts of water.

Accordingly, a substantial need exits for a device which can combine the benefits of both the ready-to-use solutions and the concentrated solutions by dispensing concentrated, potentially toxic compositions into a liquid without exposing the concentrate to the open atmosphere.

SUMMARY OF THE INVENTION

Figure 1:
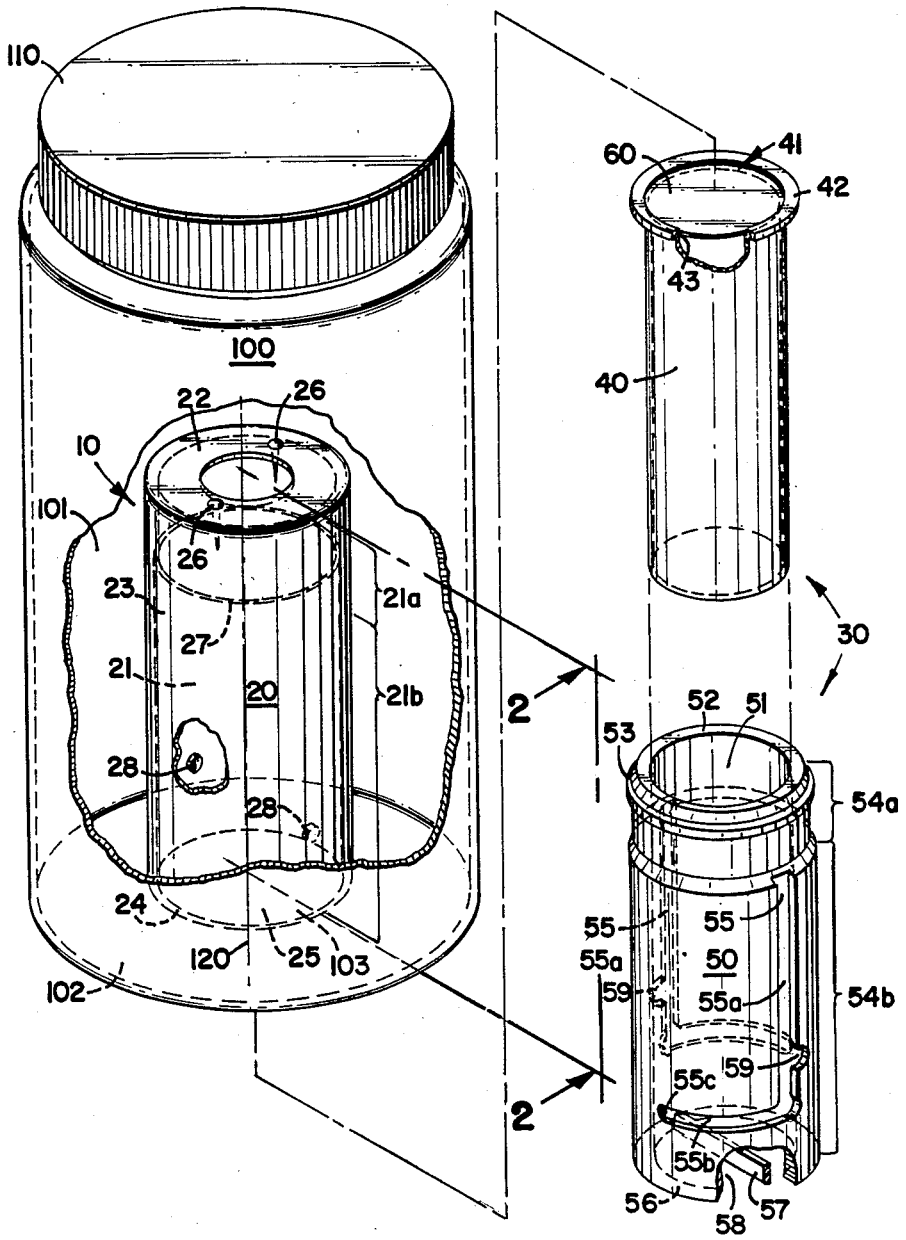
FIG. 1 is an expanded prospective view of one embodiment of my invention.

My invention is a device which can dispense a composition such as a pesticide, herbicide or fungicide into a liquid without exposing the chemical to the atmosphere. By preventing the composition from being exposed to the atmosphere during dilution, my device prevents the release of noxious fumes and prevents direct contact with the concentrated composition.

Broadly, my device comprises: (i) a jacket which defines a cylindrical cavity and has an open base and a perforated top; (ii) a cylindrical container which has an open top and is sized to be removably retained within the cavity defined by the jacket; (iii) a means for breaking a seal over the top of the container only after the container has been sealingly engaged within the jacket; (iv) a means for sealingly engaging the container and the jacket after the container has been inserted a predetermined distance into the jacket so as to prevent the flow of liquid between the sidewalls of the jacket and the container; and (v) a graspable means for allowing the container to be manipulated when the container is retained within the jacket.

The jacket is housed within and sealingly coupled to a dilution vessel such that the cavity defined by the jacket is readily accessible through the concentric open base of the jacket and an opening in the vessel.

To use, a sealed container containing the composition to be dispensed is inserted into the cavity defined by the jacket such that the sealing means has sealed the jacket and the container but the means for breaking the seal on the container has not perforated the seal over the container. The vessel is filled with liquid. The container is completely inserted into the cavity defined by the jacket such that the means for breaking the seal on the container punctures the seal on the container. Finally, a container is rotated relative to the vessel such that the opening means may rip or cut open the seal on the top of the container and release the composition into the liquid.

My device may be reused by removing and replacing an empty container with a fresh, composition-containing, sealed container and repeating the dispensing procedure. However, the vessel must be empty before replacing the container as removal of the container from the jacket allows both composition and liquid to flow freely out of the vessel through the jacket.

DETAILED DISCUSSION OF THE INVENTION INCLUDING A BEST MODE

My invention dispenses a composition into a liquid such as a solvent without exposing the composition to the atmosphere. This is useful when dispensing chemicals which are deactivated upon exposure to sunlight or the atmosphere, which release noxious fumes, or which are potentially toxic. A nonexhaustive list of compositions which may be usefully dispensed in my invention includes tetrahydrofuran which forms excessive peroxide upon exposure to the atmosphere; oncological drugs which are toxic; and pesticides, herbicides and fungicides which are potentially toxic and release noxious fumes. While not intending to be limited thereby, my invention is particularly useful in dispensing pesticides, herbicides and fungicides into water just prior to use.

Figure 3:
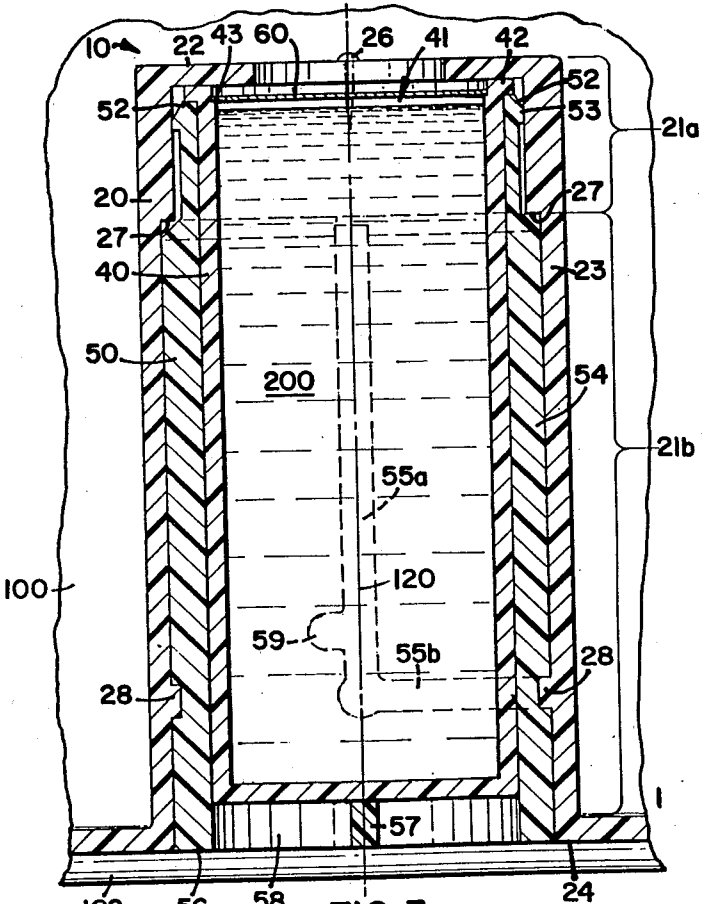
FIG. 3 is a cross sectional front view of my invention as embodied in FIGS. 1 and 2 wherein container 30 has been completely inserted into jacket 20 and rotated such that seal 60 over the top of container 30 is perforated.
Figure 2:
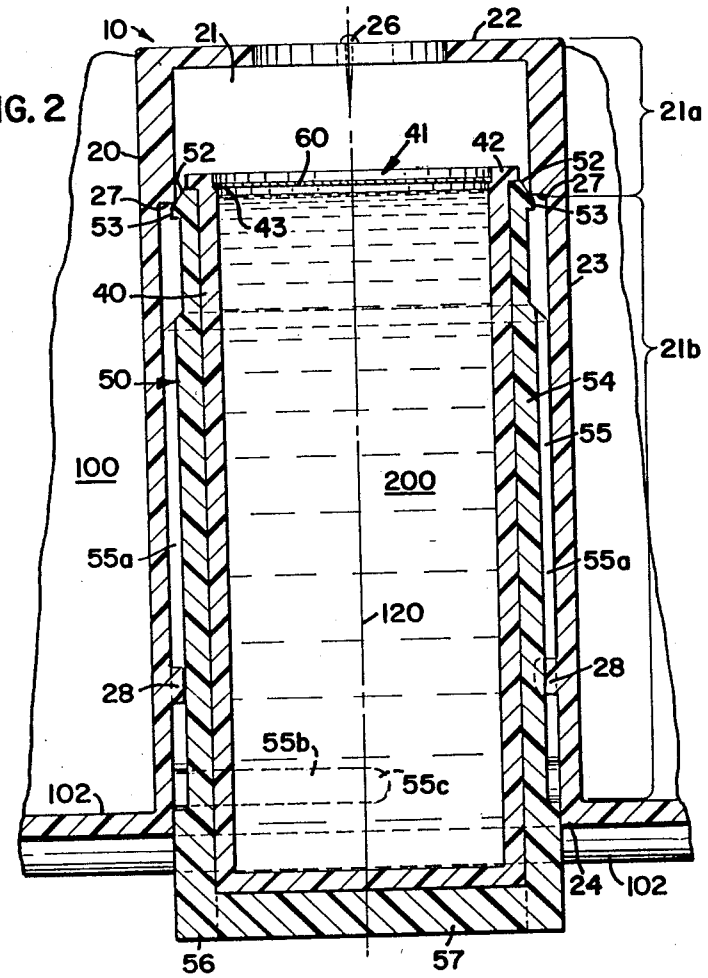
FIG. 2 is a cross sectional front view of my invention as embodied in FIG. 1 wherein container 30 is inserted a distance into jacket 20 such that jacket 20 and container 30 are sealingly engaged but the seal 60 over the top of container 30 is unbroken.

Referring generally to FIGS. 1–3, my invention 10 is employed in conjunction with a dilution vessel 100 which defines a dilution chamber 101 and has an opening 102 in its base 103 through which my invention 10 is employed.

My invention 10 comprises a jacket 20 and a container 30. Container 30 preferably comprises a sleeve 50 removably encompassing a receptacle 40. The two piece container combination 30 simplifies reuse of my invention 10 as only the inexpensive receptacle 40 need be replaced to reuse the dispenser 10.

The top 22 of jacket 20 is perforated so that liquid retained within vessel 100 may freely flow into and out of cavity 21 defined by jacket 20. At least one sharpened projection 26 extends downwardly from the top 22 of jacket 20 into cavity 21. A shoulder 27 extends from sidewall 23 into cavity 21 proximate the top 22 of jacket 20 so as to define an upper portion **21*a* of cavity 21 having a smaller diameter than a lower portion 21*b* of cavity 21. At least one protuberance 28, preferably two laterally opposed protuberances 28, project inwardly from sidewall 23 of jacket 20 into cavity 21. Protuberances 28 are shorter than shoulder 27 so that they do not completely prevent container 30 from being inserted into cavity 21**.

Jacket 20 is sealingly coupled to base 102 of vessel 100 proximate the bottom 24 of jacket 20 such that opening 103 in the base 102 of vessel 100 and opening 25 in the bottom 24 of jacket 20 are concentric along longitudinal axis 120 and cavity 21 is freely accessible through openings 103 and 25. Preferably, jacket 20 and vessel 100 are intrically coupled so as to form a single unit.

Receptacle 40 has an open top 41 through which receptacle 40 may be filled with the composition to be dispensed 200. Preferably, receptacle 40 has an outer circular flange 42 proximate the top 41 thereof for contacting the top 52 of sleeve 50 when receptacle 40 is placed therein. Receptacle 40 also has preferably has an inner circular flange 43 proximate the top 41 thereof upon which a seal 60 may be seated. The open top 41 of receptacle 40 may be sealed by any of a variety of well known sealing means but is preferably sealed with a metallized polyester such as MYLAR TM adhesively bonded to flange 43.

Sleeve 50 has an open top 52 and defines a bore 51 into which receptacle 40 may be securely inserted to form container 30.

An outer, circular, downwardly sloping flange 53 extends from sidewall 54 of sleeve 50 proximate the top 52 of sleeve 50. Flange 53 sealingly engages jacket 20 when it is forcibly inserted into the upper portion 21*a* of cavity 21. The decrease in the diameter of cavity 21 caused by shoulder 27 forces flange 53 to constrict and sealingly engage jacket 20. The upper portion 54*a* of sleeve 50 has a smaller outer diameter than the lower portion 54*b* so that the upper portion 54*a* may fit within the upper portion 21*a* of cavity 21 which has a smaller diameter than lower portion 21*b* and outer flange 53 does not sealingly contact jacket 20 until container 30 is substantially within cavity 21.

L-shaped channels 55 are recessed into sidewall 54 of sleeve 50 for accepting protuberances 28. The L-shaped channels 55 have a horizontal portion 55*a* and a vertical portion 55*b*. The L-shaped channels 55 and protuberances 28 act together to stabilize and control the insertion of container 30 into jacket 20. Protuberances 28 extend into and slide along the vertical portion 55*a* of the L-shaped channels 55 while container 30 is being inserted into jacket 20. Protuberances 28 extend into and slide along the horizontal portion 55*b* of the L-shaped channels 55 after container 30 has been completely inserted within jacket 20 and is rotated relative to jacket 20.

Lock channels 59 extend horizontally from the vertical portion 55*a* of the L-shaped channels 55 slightly above and in the opposite direction of the vertical portion 55*b* of the L-shaped channels 55. Lock channels 59 are vertically positioned such that when protuberances 28 extend into lock channels 59, flange 53 sealingly contacts jacket 20 but sharpened projections 26 do not contact seal 60.

The bottom 56 of sleeve 50 is recessed and has a gripable element 57 extending into recess 58. Gripable element 57 allows container 30 to be manipulated when container 30 is completely retained within jacket 20. Gripable element 57 should not extend beyond recess 58 so that it does not affect the ability of container 30 to rest in an upright position.

Preferably, base 102 of vessel 100 is concave such that when container 30 is inserted into jacket 20 so that protuberances 28 extend into locking channels 29, vessel 100 may stably rest in an upright position upon its base 102 despite the extension of a portion of container 30 out from the base 102 of vessel 100.

In operation, a sealed receptacle 40 containing composition to be dispensed is placed within sleeve 50 to form a container 30; container 30 is aligned with jacket 20 such that protuberances 28 extend into the vertical portion 55*a* of the L-shaped channels 55; container 30 is slid into jacket 20 until protrusions 28 are horizontally aligned with locking channels 59; container 30 is rotated until protuberances 28 abut the distal end 59*a* of locking channels 59; lid 103 of vessel 100 is removed; vessel 100 is filled with liquid; lid 103 is replaced; container 30 is rotated so that protuberances 28 once again extend into the vertical portion 55*a* of the L-shaped channels 55; container 30 is completely slid into jacket 20 until protuberances 28 are horizontally aligned with the vertical portion 55*a* of the L-shaped channels 55 and sharpened projections 26 pierce seal 60 on the container; and container 30 is rotated until protuberances 28 contact the distal end 55*c* of the horizontal portion 55*b* of the L-shaped channels 55. The final rotation of container 30 rips or cuts seal 60 open with projections 28 and releases composition 200 into the liquid (not shown). Composition 200 migrates out of receptacle 40 through broken seal 60 and out of cavity 21 through perforated top 22 of jacket 20.

If desired, vessel 100 may be agitated to hasten the release of chemical 200 into the liquid.

My invention 10 and vessel 100 may be constructed of any material which can withstand extended contact with the composition to be dispensed. Typically, my invention 10 and vessel 100 may be constructed of a sturdy plastic such as polyethylene, polypropylene, and the like. When plastic may not be employed due to its interaction with the composition to be dispensed, invention 10 and vessel 100 may be constructed of glass. However, when invention 10 and/or vessel 100 are constructed of glass the sealing means (flange 53) may require some adaptation as glass is not as flexible as plastic.

Invention 10 and vessel 100 may be sized to fit any desired and use. For example, the home use of herbicides may require a half pint container 30 and a half gallon vessel 100 while industrial use of herbicides may require a gallon container and a thousand gallon vessel 100.

The specification above is presented to aid in the complete nonlimiting understanding of the invention. Since many variations and embodiments of the invention can be made without departing from the spirit and scope of the invention, the invention resides in the claims hereinafter appended.

I claim:

1. A device for dispensing a substance into a liquid, which comprises:

(a) a jacket defining a right circular cylindrical cavity and having, a perforate top, an open bottom, a side wall, and an inner side wall surface;

(b) a cylindrical container for retaining the substance to be dispensed; the container sized to fit within the cavity defined by the jacket and having, an open top, a bottom, a longitudinal axis, a side wall, and an outer side wall surface;

(c) a means for opening the container when the top of the container is sealed; the opening means unsealing the container only when the container is substantially completely inserted into the cavity defined by the jacket and the container is rotated about its longitudinal axis relative to the jacket;

(d) a means for sealing a gap between the outer surface of the container wall and the inner surface of the jacket wall after the container is inserted an established distance into the cavity defined by the jacket; the sealing means sealing the gap prior to the opening means unsealing the container; and (e) a graspable element coupled to the container which allows the container to manipulated when the container is retained within the cavity defined by the jacket.

2. The device of claim 1 further comprising:

(a) an L-shaped channel in the side wall of the container which has a horizontal portion and a vertical portion;

(b) a protuberance extending inwardly from the side wall of the jacket and into the cavity defined by the jacket such that the protuberance will extend into and traveling along the vertical portion of the L-shaped channel when the container is inserted into the cavity and extend into and traveling along the horizontal portion of the L-shaped channel when the container is rotated about its longitudinal axis relative to the jacket.

3. The device of claim 2 further comprising a lock channel extending horizontally from the vertical portion of the L-shaped channel in a direction opposite the horizontal portion of the L-shaped channel; the lock channel being vertically positioned such than when the protuberance is positioned within the lock channel the sealing means is sealing the gap between the outer surface of the container wall and the inner surface of the jacket wall but the opening means has not unsealed the container.

4. The device of claim 3 wherein the sealing means comprises:

(a) an inner projecting shoulder proximate the top of the jacket which reduces the diameter of the top portion of the cavity; and (b) a downwardly sloping outwardly projecting circular flange proximate the top of the container.

5. The device of claim 2 wherein the sealing means comprises:

(a) an inner projecting shoulder proximate the top of the jacket which reduces the diameter of the top portion of the cavity; and (b) a downwardly sloping outwardly projecting circular flange proximate the top of the container.

6. The device of claim 1 further comprising a vessel which defines a chamber and has openable top, a base, and a appature in the base and houses the jacket within the chamber defined thereby; the vessel and the jacket sealingly engage at the periphery of the bottom of the jacket such that the open bottom of the jacket and the appature in the base of the vessel are concenntric such that the container may be inserted into the cavity defined by the jacket through the open bottom of the jacket and the appature in the base of the vessel.

7. The device of claim 1 wherein the container comprises an inner receptacle for retaining the substance to be dispensed separably retained within an outer sleeve.

8. The device of claim 1 wherein the opening means comprises a sharpened projection extending vertically downward from the top of the jacket into the cavity.

9. The device of claim 1 wherein the sealing means comprises:

(a) an inner projecting shoulder proximate the top of the jacket which reduces the diameter of the top portion of the cavity; and (b) a downwardly sloping outwardly projecting circular flange proximate the top of the container.

* * * * *